US005667293A

United States Patent [19]

Own

[11] Patent Number: 5,667,293

[45] Date of Patent: Sep. 16, 1997

[54] FLASHLIGHT WITH ILLUMINATION AND ALERTING EFFECT

[76] Inventor: James Own, 5 Fl., No. 12, Lane 240, Jien Shan Rd., Yin-ko Chen, Taipei Hsien, Taiwan

[21] Appl. No.: 633,320

[22] Filed: Apr. 17, 1996

[51] Int. Cl.[6] ..... F21L 7/00

[52] U.S. Cl. ..... 362/184; 362/205; 362/208

[58] Field of Search ..... 362/183, 184, 362/205, 253, 102, 208, 202

[56] References Cited

U.S. PATENT DOCUMENTS 2,726,321 12/1955 Riotto ..... 362/184
5,079,679 1/1992 Yen ..... 362/184
5,081,568 1/1992 Dong et al. ..... 362/184
5,117,341 5/1992 Huang ..... 362/205

*Primary Examiner*—James C. Yeung
*Attorney, Agent, or Firm*—Bacon & Thomas

[57] ABSTRACT

A flashlight with illumination and alerting effect comprises mainly a control circuit and an illumination and alerting device, wherein the control circuit is located within a handle body of the flashlight and elastic push buttons are exposed on button holes formed on the handle body, with the illumination and alerting device being located within a transparent lamp hood for the flashlight so that through selection with a push button the flashlight can be used for both illumination and a alerting purpose, and designated color light can be selected from among a plurality of alerting lamp sets to emit lights of different colors for alerting purpose.

13 Claims, 4 Drawing Sheets

FLASHLIGHT WITH ILLUMINATION AND ALERTING EFFECT

BACKGROUND OF THE INVENTION (a) Field of the Invention

The present invention provides a flashlight with illumination and alerting effect, and particularly a flashing which can be used for both illumination purpose and providing an alerting light signal of different colors.

(b) Description of the Prior Art

Conventionally a flashlight is a convenient light source during nighttime or upon power failure. To provide other functions there are some flashlight designs on the market which provide both illumination and alerting effects. However, such kind of flashlights are either (1) of the type using a retractile lamp hood to locate a bulb within the lamp hood in order to give an alerting signal but can also provide illumination and alerting effect simultaneously, can emit only a certain color light due to the color of the lamp hood used, requires change of lamp hood if another color light is desired; or (2) of the type using the front section of the flashlight as an alerting device to emit twinkling color light, and can only provide a certain color of light according to the color of the lamp hood used.

SUMMARY OF THE INVENTION

The main objective of the present invention is to provide a flashlight with both illumination and alerting effect in a simple, convenient and easy-to-use design which can select a color light from a number of choices simply by pushing a button.

Another objective of the present invention is to provide a flashlight with both illumination and alerting effect to meet different circumstances by providing a plurality of color lights, such as yellow light for heavy fogging, red light for emergency condition, and green light for traffic control so that its use is convenient and practical.

Another objective of the present invention is to provide a flashlight with both illumination and alerting effect which uses bulb and color hood for the alerting so that light intensity is greatly improved and a combination of color hoods can be used to meet different requirements.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENTS

Figure 1:
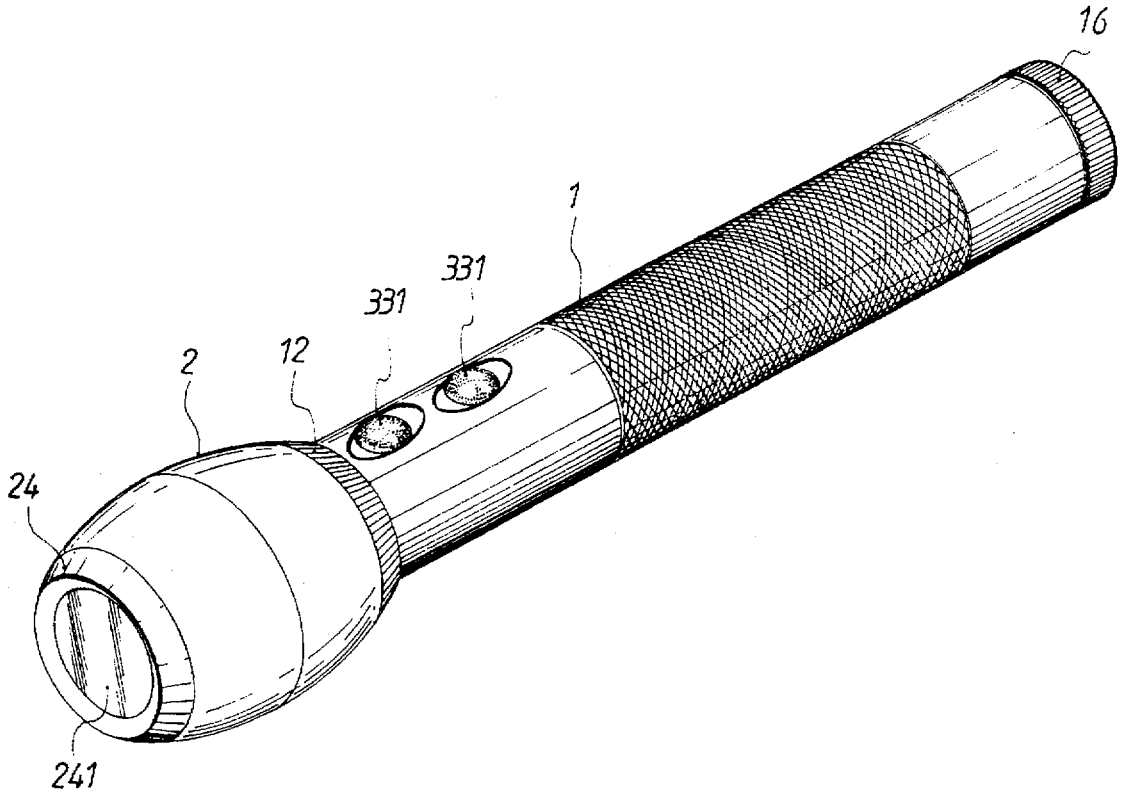
FIG. 1 is a perspective view of the flashlight according to the present invention.
Figure 2:
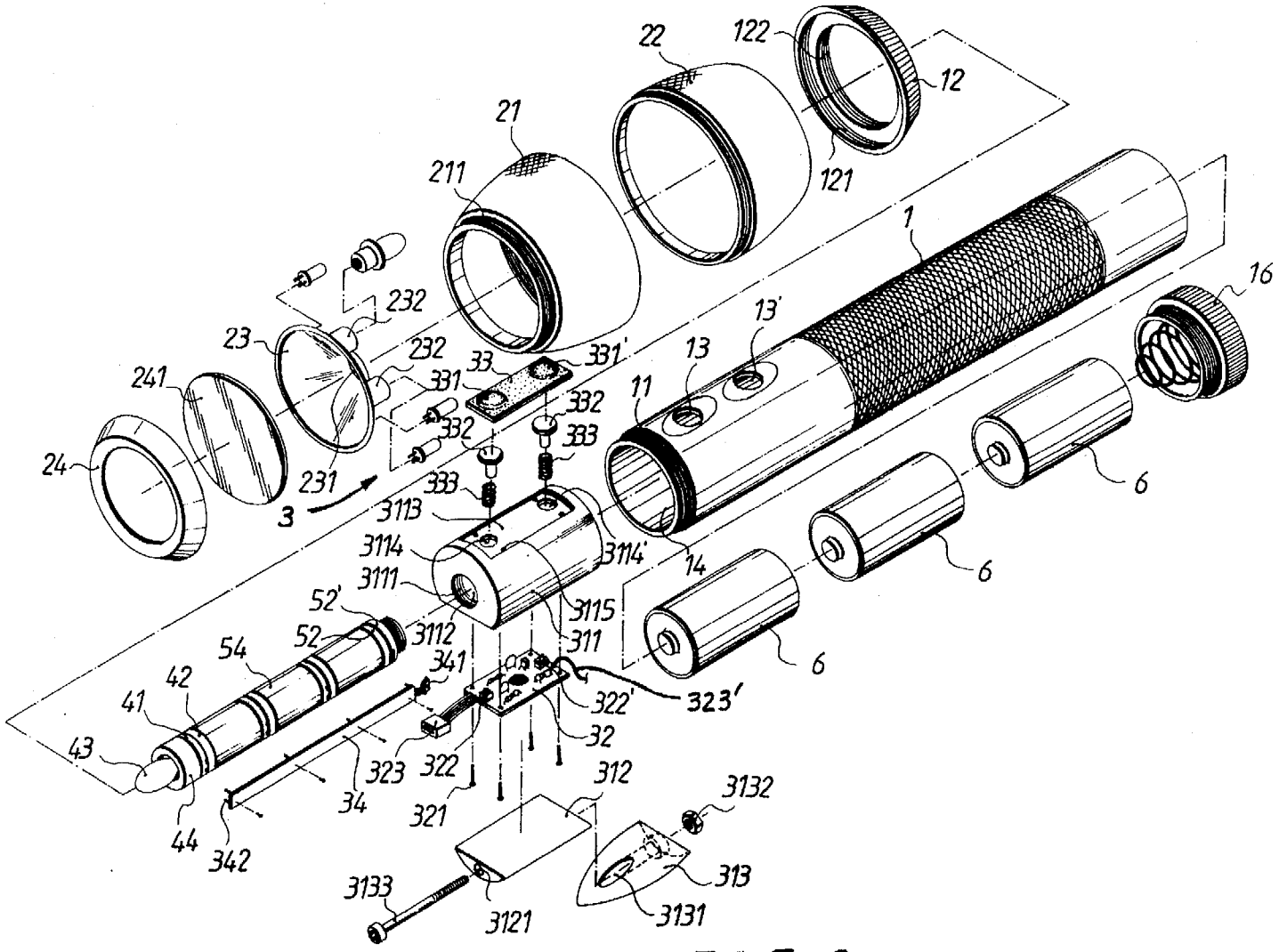
FIG. 2 is a fragmented perspective view of the flashlight according to the present invention.

As shown in FIGS. 1 and 2, the flashlight with illumination and alerting effect according to the present invention comprises a handle body (1), a lamp hood (2), control circuit (3), and an illumination and alerting device.

The handle body (1) is a hollow tubular structure with an outer thread (11) at its front end for positioning and retention of a locking ring (12). The locking ring (12) is designed with two stepped inner threads (121, 122) on its inner surface. The handle body (1) is formed with two button holes (13, 13') on its wall at appropriate positions. The interior of the handle body (1) is in the form of a hole with two steps (14, 15), and the rear end of the handle body (1) is incorporated with a battery chamber cover (16).

The lamp hood (2) is a transparent hood body formed by two half-shell elements (21, 22). An outer thread (211) is formed on the front end of the lamp hood (2) and another outer thread (221) is formed on the rear end of it. A convergent hood (23) is incorporated at the front end of the lamp hood (2). A hole (231) is formed at the center of the convergent hood (23), and a plurality of bulb holders (232) are formed on the back of the convergent hood (23). The convergent hood (23) is incorporated with a hood (24) and a transparent plate (241) which are locked and positioned on the outer thread (211) at the front end of the lamp hood (2), while the outer thread (221) at the rear end of the lamp hood (2) is retained by the stepped inner thread (121) at the locking ring (12) of the handle body (1).

The control circuit (3) is retained within the large step (14) of the handle body (1). It comprises mainly a printed circuit board holder (31), a printed circuit board (32), an elastic push button (33) and a connecting element (34). The printed circuit board holder (31) is a cylindrical structure consisting of a sleeve (311), a sectional element (312) and a slant element (313). The sleeve (311) is formed with an inner screw hole (3111) on the wall of its front end. The inner screw hole (3111) connects to a hollow chamber (3112) within the sleeve (311). On the top surface of the sleeve (311) a slot (3113) is formed. In the slot (3113) are provided two passing holes (3114, 3114') at predetermined locations. At each corner of the slot (3113) a screw hole (3115) is formed. A through hole (3116) is formed on the wall of the rear end of the sleeve (311). The sectional element (312) is designed so as to keep flush with the bottom of the sleeve (311), and has a slant plane at its the bottom surface, and a longitudinal hole (3121) along its longitudinal central line. The slant element (313) is designed so as to keep flush with the slant plane on the bottom of the sectional element (312), and has a longitudinal hole (3131) along its longitudinal central line. A nut (3132) is fixed at the opening of an end of the longitudinal hole (3131), a screw (3133) is inserted through the longitudinal hole (3121) of the sectional element (312) and the longitudinal hole (3131) of the slant element (313) and secured thereto by the nut (3132). The printed circuit board (32) is secured within the hollow chamber (3112) of the sleeve (311). The printed circuit board (32) is provided with two elastic switches (322, 322') at positions corresponding to the passing holes (3114, 3114') respectively, and incorporated with a cable connector (323) at its front end, a conductive wire at the rear end. The conductive wire is soldered to a conductive copper plate (324) which is riveted to the through hole (3116) on the rear wall of the sleeve (311) and connected to the positive pole of a battery (6). The elastic push button (33) is positioned in the slot (3113) on the sleeve (311). On the push button (33) there are two dots (331, 331') each covering a T-shaped pin (332) incorporated with a spring (333). The pins (332) extend into the passing holes (3114, 3114') of the sleeve (311), and bottom ends maintained in contact with the elastic switches (322, 322') of the printed circuit board (32). The connecting element (34) is made of transparent material with a conductive wire incorporated therewith. An end of the conductive wire is connected to a plug (341) for connecting to the cable connector (323) of the printed circuit board (32).

Figure 3:
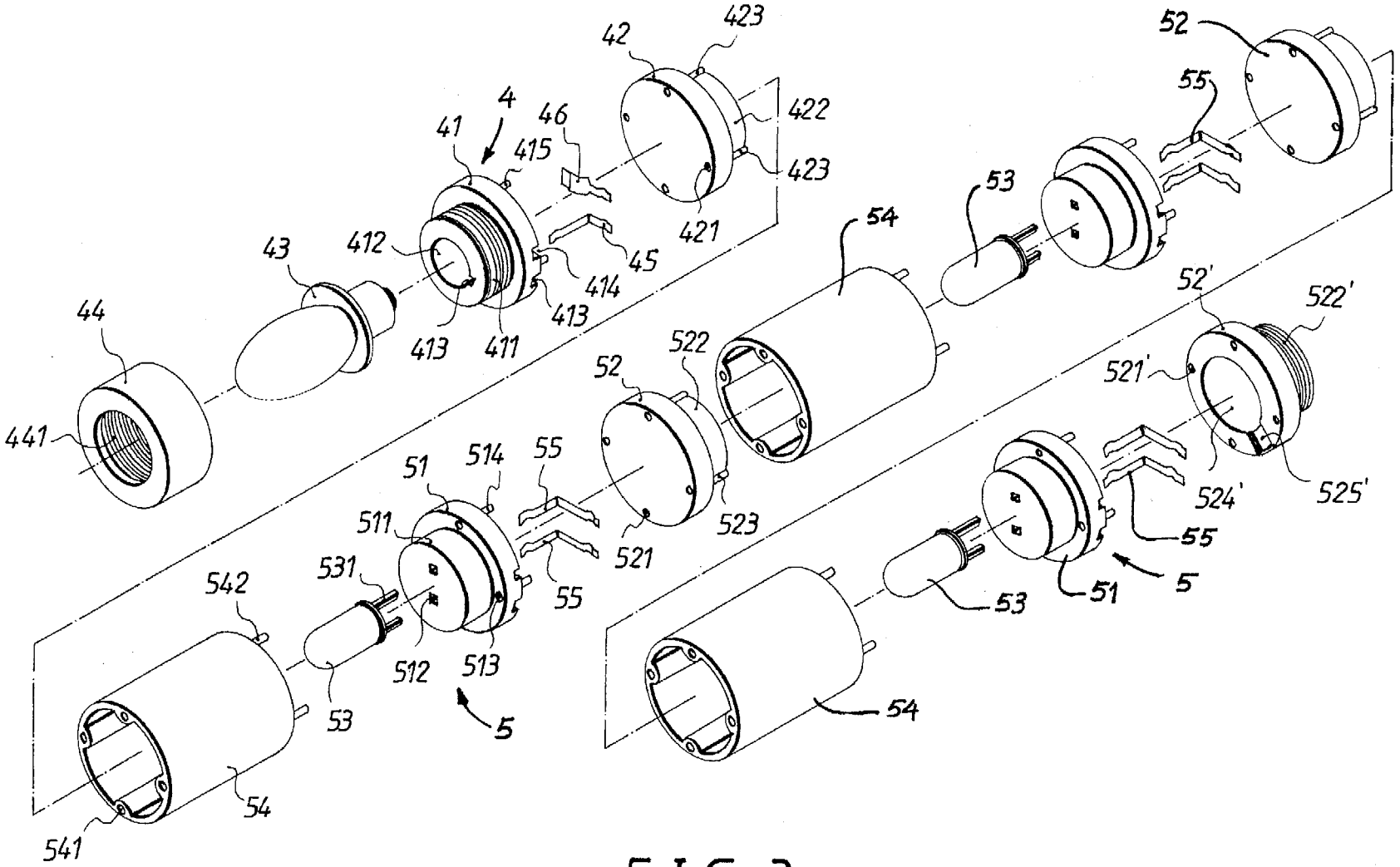
FIG. 3 is a fragmented perspective view of an illumination and alerting device according to the present invention.
Figure 4:
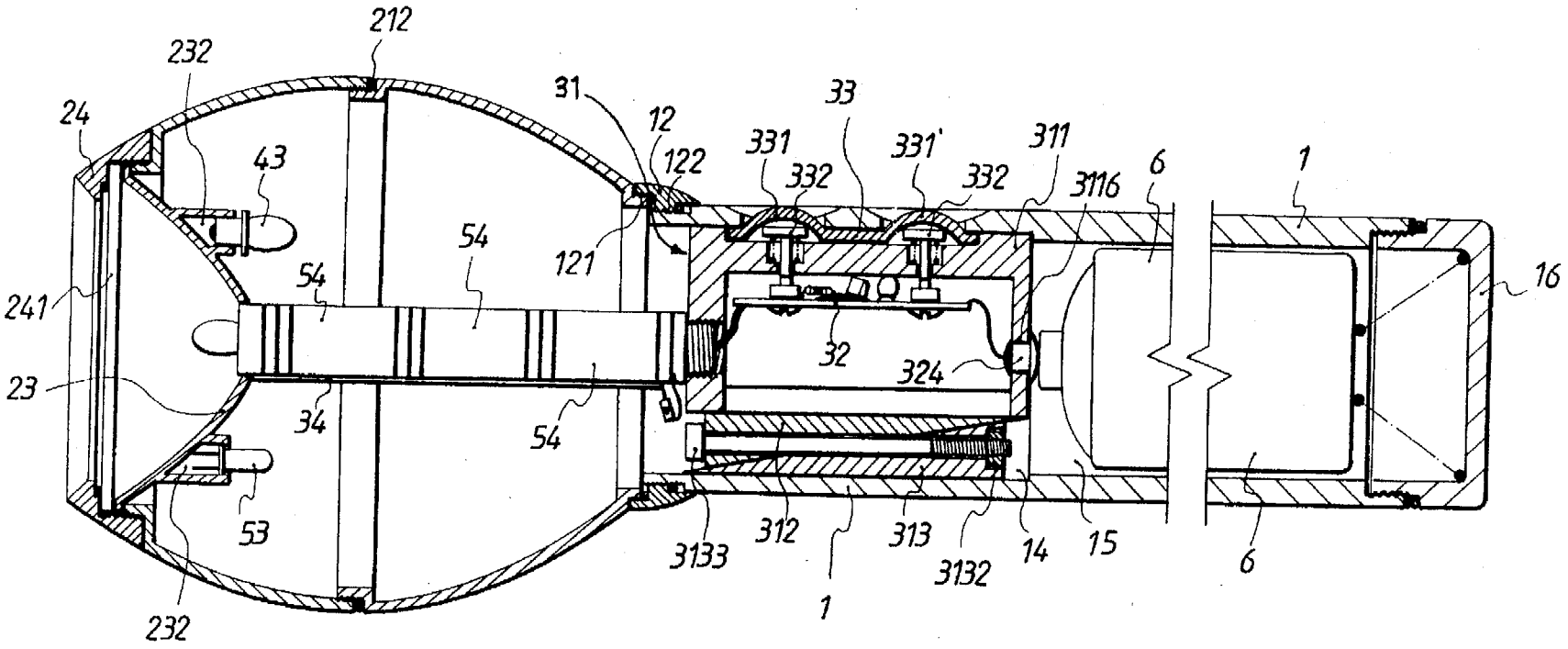
FIG. 4 is a sectional view illustrating assembly of the flashlight according to the present invention.

Pins (342) are provided on the connecting element (34) at predetermined intervals for connecting to a plurality of metal conductive plates (45, 46, 55) on the alerting and illumination device as shown in FIG. 3.

The alerting and illumination device, consists of an illumination lamp set (4) and at least one alerting lamp set (5) located within the lamp hood (2).

The illumination lamp set (4) as seen in FIG. 3 comprises a bulb holder (41), a connection element (42), a bulb (43), and a locking element (44). The bulb holder (41) is formed with an outer screw post (411) at its front end. The outer screw post (411) has a longitudinal hole (412) along its central line. On the wall of the longitudinal hole (412) an L-shaped key slot (413) is formed and extended to its bottom end. An L-shaped metal conductor strip (45) is retained within the L-shaped key slot (413). On the surface of the bottom of the bulb holder (41) a key slot (414) is formed to hold a metal conductor strip (46), while the circumference of the bottom surface is provided with a plurality of pins (415). The surface at the front end of the connection element (42) is provided with a plurality of pin holes (421) corresponding to the number and position of the respective pins (415) while a cylindrical post (422) is provided at the center of its bottom surface. Around the outer circumference of the cylindrical post (422) are provided a plurality of posts (423). The bulb (43) is disposed in the longitudinal hole (412) of the bulb holder (41) with its bottom maintaining contact with the metal conductor strip (46) and its side edge maintaining contact with the metal conductor strip (45), and is fixed to the bulb holder (41) by the locking element (44) which includes an inner threaded hole (441) that engages with the screw post (411).

Each alerting lamp set (5) comprises an alerting lamp holder (51), a connecting element (52), an alerting bulb (53), and a color hood (54). The surface of the front end of the alerting lamp holder (51) is formed with a cylindrical post (511) of relatively small diameter and having two L-shaped key slots (512) extending to the bottom of the alerting lamp holder (51). In each of the L-like key slots (512) an L-like metal conductor strip (55) is fixed. A plurality of pin holes (513) are provided around the outer circumference of the cylindrical post (511) at the front end of the alerting lamp holder (51), while a plurality of pins (514) are provided around the circumference of its bottom. The connecting element (52) is designed with a plurality of pin holes (521) around the circumference of its front end corresponding to the number and position of the respective pins (514), and formed with a cylindrical post (522) at the center of its bottom surface. The cylindrical post (522) is provided with a plurality of pins (523) around its outer circumference. The alerting bulb (53) is fixed to the key slots (512) of the alerting lamp holder (51) with two pins (531) extending from its bottom. The color hood (54) is a transparent structure of any designated color, and has a plurality of pin holes (541) at the wall of its front end corresponding to the number of pins (423 or 523) provided at the connecting element (42 or 52), while a plurality of pins (542) are provided at the wall of its bottom end corresponding to the number of pin holes (513) provided at the alerting lamp holder (51). While the aforesaid connecting element (52) is used as a component of the last alerting lamp set (5), the other connecting element (52') is formed with a passing hole (524') at its center, and has a plurality of pin holes (521') at its front end corresponding to the number and position of the pins (514) provided at the alerting lamp holder (51), a cable passage (525') on its wall, and a screw post (522') at the center of its bottom surface.

With the aforesaid characteristics, these components are assembled in the manner described below. The printed circuit board (32) is first placed in the hollow chamber (3112) of the sleeve (311) and fixed thereto by engaging a plurality of screws (321) in the screw holes (3115), while the cable connector (323) is led to pass through the inner screw hole (3111). The conductive copper plate (324) of the printed circuit board (32) is riveted to the through hole (3116) of the sleeve (311). The bottom of the sleeve (311) is adhered to the sectional element (312) and the slant element (313) to become a cylindrical printed circuit board holder (31). Then, screw (3133) is inserted through the longitudinal holes (3121 and 3131) respectively and tightened thereto to provide an adequate locking effect. On the sleeve (311) the dots (331, 331') are fixed to the elastic push button (33) by means of the two respective pins (331) and then each of the dots (331, 331') is surrounded by a spring (333) before they are placed into the passing holes (3114, 3114') of the sleeve (311). The control circuit (3) produced from the above assembly procedure is inserted into the large stepped hole (14) of the handle body (1) in a manner that the dots (331, 331') of the elastic push button (33) are exposed outside the push button elements (13, 13') of the handle body (1). The screw (3133) is then tightened so that the sectional element (312) and the slant element (313) are displaced along a straight line to expand the diameter of the printed circuit board holder (31) and cause the printed circuit board holder (31) be firmly retained at the large stepped hole (14). Thereafter, the illumination lamp set (4) is assembled. The key slot (413) and the key slot (414) of the bulb holder (41) are first provided with the metal conductor strip (45) and the metal conductor strip (46) respectively, and then the pins (415) are engaged with the pin holes (421) of the connecting element (42) to fix the bulb holder (41) to the connecting element (42). The bulb (43) is then inserted in the longitudinal hole (412) of the bulb holder (41) and fixed therein by threading the locking element (44) which with the outer screw post (411) of the bulb holder (41). As for assembly of the alerting lamp sets (5), for each alerting lamp set (5) the a metal conductor strip (55) is inserted in each of the two key slots (512) of the alerting lamp holder (51) and the pins (514) are fixed to the pin holes (521) of the connecting element (52) to fix the alerting lamp holder (51) to the connecting element (52). Then, each of the pins (531) of the alerting bulb (53) is inserted in the hole at the front end of each key slot (512) so that the alerting bulb (53) is positioned. Then, the color hood (54) is fixed by inserting the pins (542) at its bottom into the pin holes (513) of the alerting lamp holder (51) to complete assembly of an alerting lamp set (5). Each alerting lamp set (5) is provided with a plurality of pin holes (541) at its front end for receiving pins (523) of at the connecting element (52) for the previous alerting lamp set (5) in order to connect to the previous alerting lamp set (5). However, for connection of the first alerting lamp set (5) to the illumination lamp set (4), the pin holes (541) at the color hood (54) are engaged by the pins (423) of the connecting element (42) for the illumination lamp set (4). As for the last alerting lamp set (5), the cable connector (323) of the printed circuit board (32) is led to pass through the passing hole (524') and then the cable passage (525') of a connecting element (52'), and then the screw post (522') of the connecting element (52') is fixed to the screw hole (3111) provided at the sleeve (311) of the printed circuit board holder (31) in order to secure the whole alerting lamp set (5). Then, the plug (341) is connected to the cable connector (323) of the printed circuit board (32), the pins (342) provided at the connecting elements (34) are inserted into respective holes at the ends of the key slot (413) and the key slot (414) of the illumination lamp set (4), and the pins (342) being maintained in contact with the metal conductor strip (46) and the metal conductor strips (45, 55). Finally, the lamp hood (2) is assembled. The two half-shell elements (21, 22) of the lamp hood (2) are first fixed together to become a hood structure, with a transparent gasket (212) placed therebetween then to provide an air-tight effect assembly. After installation of spare bulb (43) for illumination purpose and spare bulbs (53) for alerting purpose at the bulb holders (232) on the convergent hood (23), the convergent hood (23) is placed within the lamp hood (2), and the front end of the lamp hood (2) is covered with the transparent plate (241). The hood (24) is locked by the outer thread provided on the lamp hood (1) so that the convergent hood (23) is positioned therewith. Then, the locking ring (12) is fixed by engaging its inner thread (122) with the outer thread (11) formed at the front end of the handle body (1) and the lamp hood (2) is fixed by engaging the outer thread (221) on its rear end with the inner thread (121) of the locking ring (12) so that the lamp hood (2) is fixed to the front end of the handle body (1). The illumination bulb (43) of the illumination lamp set (4) is located in front of the hole (231) of the convergent hood (23), while the alerting lamp sets (5) are within the transparent lamp hood (2). After placing a battery (6) into the hole (15) of the handle body (1) and locking the battery chamber cover (16), the assembly of a flashlight with illumination and alerting effect is completed.

In the flashlight with illumination and alerting effect according to the present invention, the positive pole of the battery (6) connects to the conductive copper plate (324) of the printed circuit board (32), and its negative pole connects to the handle body (1) made of metallic material. If non-metallic material is used to make the handle body, (1) then a conductive plate must be installed in the hollow space within the handle body (1) for electric conductivity. While using the flashlight according to the present invention for illumination purpose, the locking ring (12) can be rotated to adjust the position of the lamp hood (2) so as to change the relative distance between the convergent hood (3) and the bulb (43), which consequently changes the focal distance to adjust the illumination intensity.

The bulb (53) in each of the alerting lamp set (5) according to the present invention can be controlled by the printed circuit board (32) at the control circuit to provide either a twinkling effect or a constant lighting effect. The dots (331, 331') on the elastic push button (33) are used to control the elastic switches (322, 322') of the printed circuit board (32), one for selection of On, Twinkling, or Off modes, and the other for selection of illumination lamp set (4) or alerting lamp set (5). In this manner, alerting lamp sets (5) with different color hoods (54) can be selected to provide alerting lighting signals of different colors. As the design of such a circuit is not within the scope of the invention, it will not to be described in detail herein. The provision of spare bulb at the back of the convergent hood (23) in the lamp hood (2) allows prompt availability a bulb whenever the working bulb is burnt out.

Many changes and modifications in the above embodiment of the invention can, of course, be carried out without departing from the scope thereof. Accordingly, to promote the progress in science and the useful arts, the invention is disclosed and is intended to be limited only by the scope of the appended claims.

I claim:

1. A flashlight with illumination and alerting effect comprising:

a) a hollow tubular handle body including a front end and a rear end, an outer thread on the front end, a locking ring positioned and retained on the outer thread, a pair of push buttons on the handle body, and a battery chamber at the rear end;

b) a transparent lamp hood including a front end and a rear end, an outer thread on the front end, an outer thread on the rear end, and a convergent hood and a transparent plate disposed at the front end;

c) a control circuit secured within the handle body adjacent the front end thereof, the control circuit including a printed circuit board holder, a printed circuit board, an elastic push button, and a connecting element;

d) an illumination and alerting device disposed within the lamp hood and positioned behind the convergent hood, the device including an illumination lamp set and at least one alerting lamp set positioned behind the illumination lamp set;

e) the alerting lamp set including an alerting lamp holder having a front surface and a bottom surface, a connecting element having a front surface and a bottom surface, a bulb provided with a pair of pins extending from a bottom surface thereof and a color hood, wherein the lamp holder includes a cylindrical post extending from the front surface, a pair of L-shaped slots extending from the cylindrical post to the bottom surface of the lamp holder, a pair of L-shaped metal conductor strips disposed within the L-shaped slots, a plurality of pin holes formed in the front surface around the outer circumference of the cylindrical post, and a plurality of pins circumferentially spaced around and extending outwardly of the bottom surface;

f) the connecting element including a plurality of pin holes circumferentially spaced around the front surface thereof, the pin holes corresponding in number and location to the pins of the lamp holder, a cylindrical post at the center of and extending outwardly from the bottom surface of the connecting element, and a plurality of pins formed around the outer circumference of the cylindrical post;

g) the pair of pins extending from the bottom surface of the bulb being inserted within the L-shaped slots of the cylindrical post of the lamp holder, the color hood being transparent and including a front surface and a bottom surface, a plurality of pin holes formed in the front surface of the color hood and a plurality of pins extending outwardly from the bottom surface of the color hood; and h) wherein at least one alerting lamp set being secured behind the illumination lamp set so that upon pushing of the elastic push button and actuation of the control circuit by a user, the illumination lamp set or the at least one alerting lamp set may be turned on for constant or intermittent lighting.

2. The flashlight of claim 1 wherein the locking ring includes a front stepped thread and a rear stepped thread, the front stepped thread being engaged with the outer thread on the rear end of the lamp hood and the rear stepped thread is engaged with the outer thread on the front end of the handle body.

3. The flashlight of claim 1 wherein the handle body defines an interior space formed from a front stepped hole and a rear stepped hole, the control circuit being disposed within the front stepped hole and the rear stepped hole forming the battery chamber for holding a battery.

4. The flashlight of claim 1 wherein the convergent hood includes a center hole for receiving a bulb of the illumination lamp set.

5. The flashlight of claim 1 or 4 further including a plurality of sockets formed on a back of the convergent hood for storing spare bulbs.

6. The flashlight of claim 1 wherein the printed circuit board holder of the control circuit includes a cylindrical sleeve including a hollow interior space, a front wall and a side wall, a screw hole formed in the front wall and extending into the hollow space, the side wall having a slot formed therein and a pair of holes extending through a bottom of the slot, a sectional element for flush engagement with the sleeve, the sectional element including a slant plane on a bottom surface thereof and a central longitudinal hole formed therethrough, a slant element for flush engagement with the slant plane of the sectional element, the slant element including a central longitudinal hole extending therethrough, and fastener means extending through the longitudinal holes of the sectional element and slant element for securing same together and urging the sectional element into engagement with the cylindrical sleeve and the slant element into engagement with the handle body.

7. The flashlight of claim 6 further including a threaded fastener securing the printed circuit board to the sleeve, a cable connector for connecting the printed circuit board to the illumination and alerting device, and a conductive cable for connecting the printed circuit board to the battery.

8. The flashlight of claim 6 wherein the elastic push button of the control circuit is secured within the slot on the cylindrical sleeve and includes a pair of dot means, a pair of T-shaped pins, each dot means covering a T-shaped pin, a spring surrounding each T-shaped pin, each T-shaped pin extending through a hole formed in the bottom of the slot for engaging an elastic switch on the printed circuit board.

9. The flashlight of claim 1 wherein the connecting element includes a circuit board formed of transparent material and provided with a conducting circuit thereon, the conductive circuit including an end connected to a plug for connection to the printed circuit board, and a plurality of pins are provided on the connecting element for contacting the metal conductor strips of the illumination and alerting device.

10. The flashlight of claim 1 wherein the pin holes of the color hood for the at least one alerting lamp set are positioned directly behind the illumination lamp set and are engaged by the pins of the connecting element of the illumination lamp set so that the alerting lamp set is secured behind the illumination lamp set.

11. The flashlight of claim 6 further including a plurality of alerting lamp sets positioned behind the illumination lamp set, the rearmost alerting lamp set including a center hole, a front end, a plurality of pin holes spaced around the front end, a passage formed in the front end for receiving a cable, and a threaded post extending rearwardly from a bottom surface thereof.

12. The flashlight of claim 11 wherein the threaded post of the rearmost alerting lamp set is threadedly engaged within the hole formed in the front wall of the sleeve.

13. The flashlight of claim 1 further including a plurality of alerting lamp sets, with each alerting lamp set including a color hood of a different color.

* * * * *